US005183122A

United States Patent [19]

Rowbotham et al.

[11] Patent Number: 5,183,122

[45] Date of Patent: Feb. 2, 1993

[54] DERRICK ASSEMBLY CAPABLE OF CONVEYING PIPE SECTIONS BETWEEN A DRILL STRING AND A RACK FOR SAID PIPE SECTIONS

[75] Inventors: Ronald H. Rowbotham, Red Deer; Gregory T. Cassady, Edmonton, both of Canada

[73] Assignee: Roll'n Well Servicing Inc., Red Deer, Canada

[21] Appl. No.: 733,876

[22] Filed: Jul. 22, 1991

[51] Int. Cl.[5] ..... E21B 7/02; E21B 15/04; E21B 19/14

[52] U.S. Cl. ..... 175/52; 175/85; 414/22.58; 414/22.71

[58] Field of Search ..... 175/85, 52, 24, 423; 414/22.53, 22.56, 22.58, 22.61, 22.62, 22.63, 22.65, 22.66, 22.67, 22.68, 22.69, 22.71

[56] References Cited

U.S. PATENT DOCUMENTS 3,768,663 10/1973 Turner, Jr. et al. ..... 414/22.71 X
3,870,165 3/1975 Besijn ..... 414/22.71
4,462,733 7/1984 Langowski et al. ..... 414/22.71
4,610,315 9/1986 Koga et al. ..... 175/85

*Primary Examiner*—Terry Lee Melius

[57] ABSTRACT

A derrick assembly capable of conveying pipe sections between a drill string and a rack for storing the pipe sections. The assembly includes a frame having lateral sidewalls and a base together defining an elongated channel having an open outer side opposite to the base. A rack for housing pipe sections is positioned within the channel adjacent to one lateral sidewall leaving part of the channel clear for manipulating the drill string. The rack is formed by a number of elements extending between the base and the open outer side for housing pipe sections oriented generally longitudinally within the channel. A gantry extends across the open outer side of the channel and is movable longitudinally of the channel. The gantry supports a pipe gripping unit for selectively gripping or releasing pipe sections capable of moving towards or away from the base and laterally between the sidewalls. The pipe gripping unit can thus convey pipe sections between the rack and the clear part of the channel by appropriate movements in the stated directions.

12 Claims, 9 Drawing Sheets

DERRICK ASSEMBLY CAPABLE OF CONVEYING PIPE SECTIONS BETWEEN A DRILL STRING AND A RACK FOR SAID PIPE SECTIONS

BACKGROUND OF THE INVENTION

I. Field of the Invention

This invention relates to derrick rigs used for attaching drill tubing to or removing drill tubing from a drill string at a well head.

II. Description of the Prior Art

The conventional way of lengthening or shortening a drill string made up of interconnected pipe sections at a well head is by means of a derrick, i.e. a framework tower constructed over the well head and including a hoist for raising or lowering the drill string. Once the drill string has been raised or lowered by a distance corresponding to the length of one or more pipe sections, the drill string is clamped at the well head and either projecting pipe sections are removed (if the drill string is being shortened) or new pipe sections are added (if the drill string is being lengthened), and the process is repeated.

This procedure requires an operator, usually referred to as a derrickman, to transfer the pipe sections between the drill string and a storage station for the pipe sections. This is inefficient and can be dangerous for the derrickman.

Attempts have been made in the past to automate this procedure to avoid the need for a derrickman. However, these attempts have generally required an operation in which pipe sections have to be laid out on the ground, where the pipe couplings may be contaminated with mud or the like, and in which single pipe sections are handled individually.

OBJECTS OF THE INVENTION

Accordingly, it is an object of the present invention to provide a derrick assembly capable of conveying pipe sections automatically between a drill string and a storage rack for the pipe sections.

Another object of the invention, at least in its preferred forms, is to provide such an assembly capable of handling interconnected double pipe sections.

SUMMARY OF THE INVENTION

According to the invention there is provided a derrick assembly for raising or lowering a drill string made of interconnected pipe sections, comprising: a derrick frame having lateral sidewalls and a base together defining an elongated channel having an open outer side opposite to said base; a rack positioned within said channel adjacent to one lateral sidewall thereof leaving part of said channel clear for manipulating said drill string, said rack comprising at least one element extending between said base and said open outer side for housing pipe sections therebetween substantially longitudinally aligned within said channel; a gantry extending across said open outer side of said channel, said gantry being movable longitudinally of said channel; and a pipe gripping unit supported by said gantry for selectively holding or releasing pipe sections, said gripping unit being movable on said gantry towards or away from said base and laterally between said sidewalls; whereby said pipe gripping unit may be manipulated on said gantry to transfer pipe sections between said rack and said clear part of said channel for attachment to or detachment from said drill string.

The invention also relates to a racking assembly comprising the gantry and gripping unit as defined above.

DETAILED DESCRIPTION OF THE PREFERRED EMBODIMENTS

Figure 2:
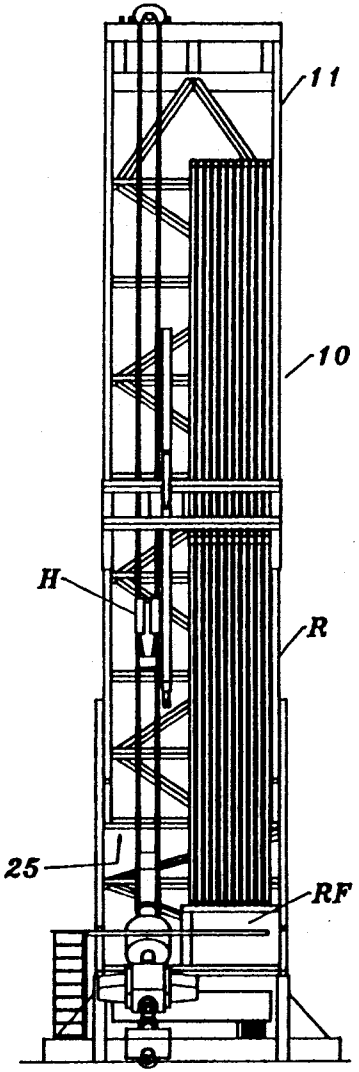
FIG. 2 is a rear elevation of the slant service rig of FIG. 1.
Figure 1:
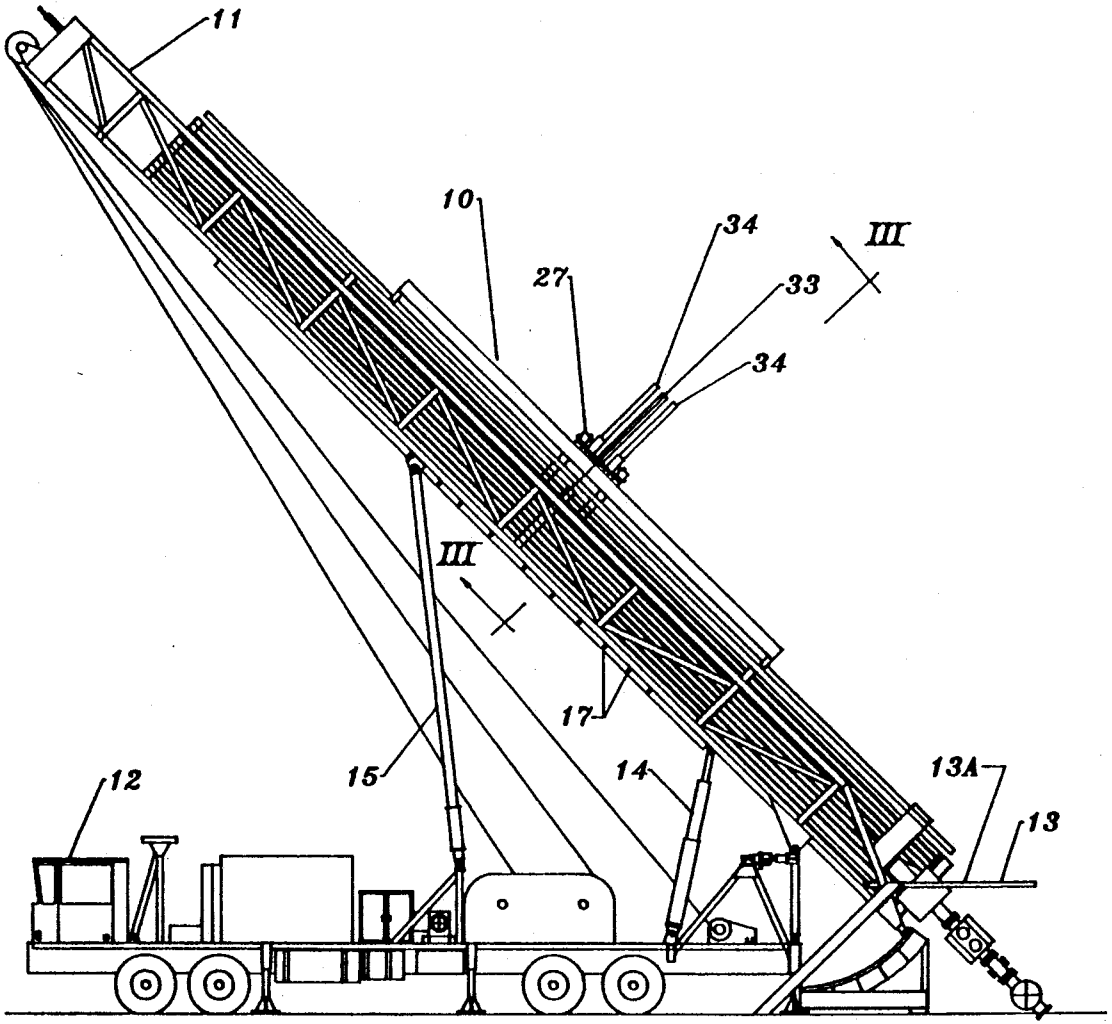
FIG. 1 is a side elevation of a transporter vehicle at a slant well head, the transporter vehicle being provided with a derrick assembly according to a preferred form of the present invention to form a slant service rig.
Figure 3:
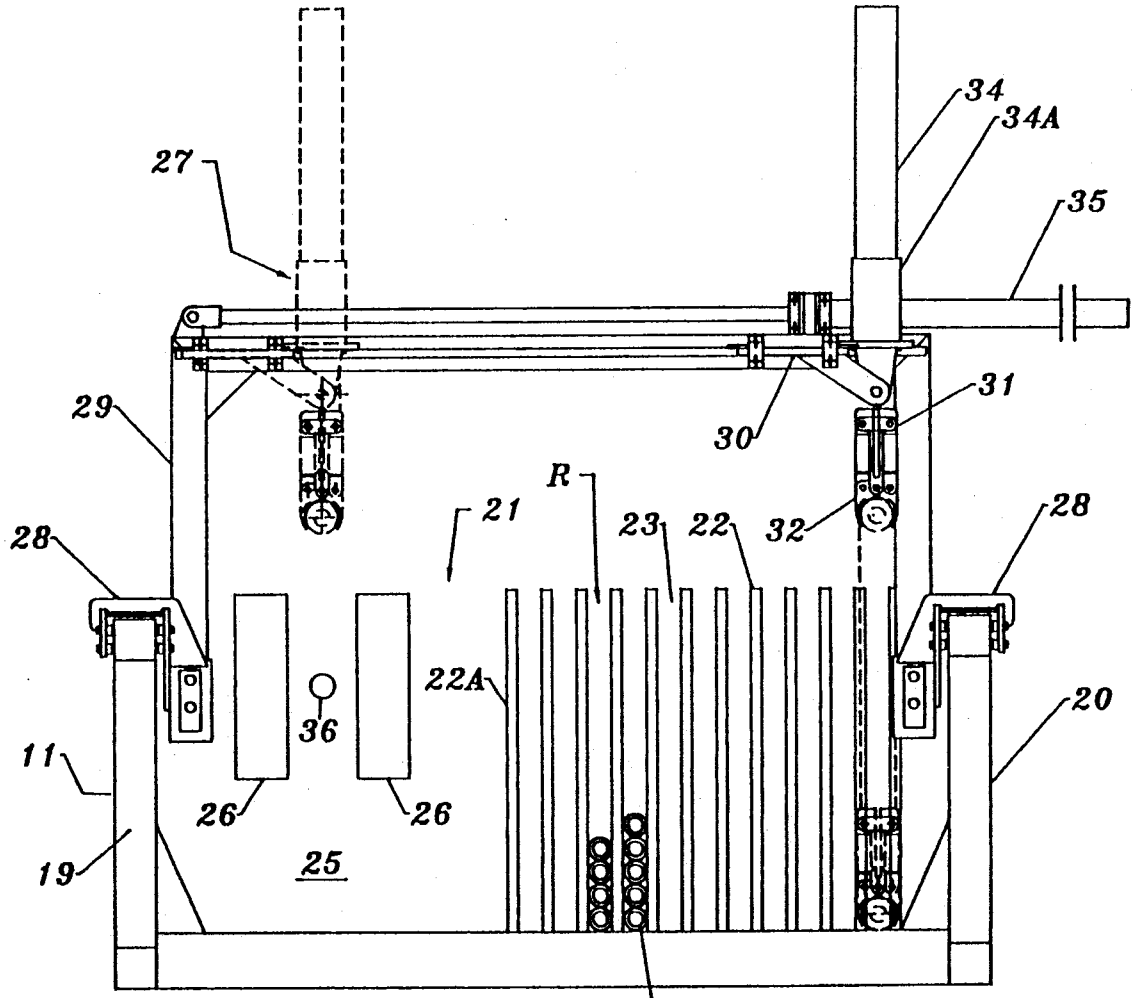
FIG. 3 is a cross-section of the derrick assembly along the line III—III of FIG. 1.
Figure 4:
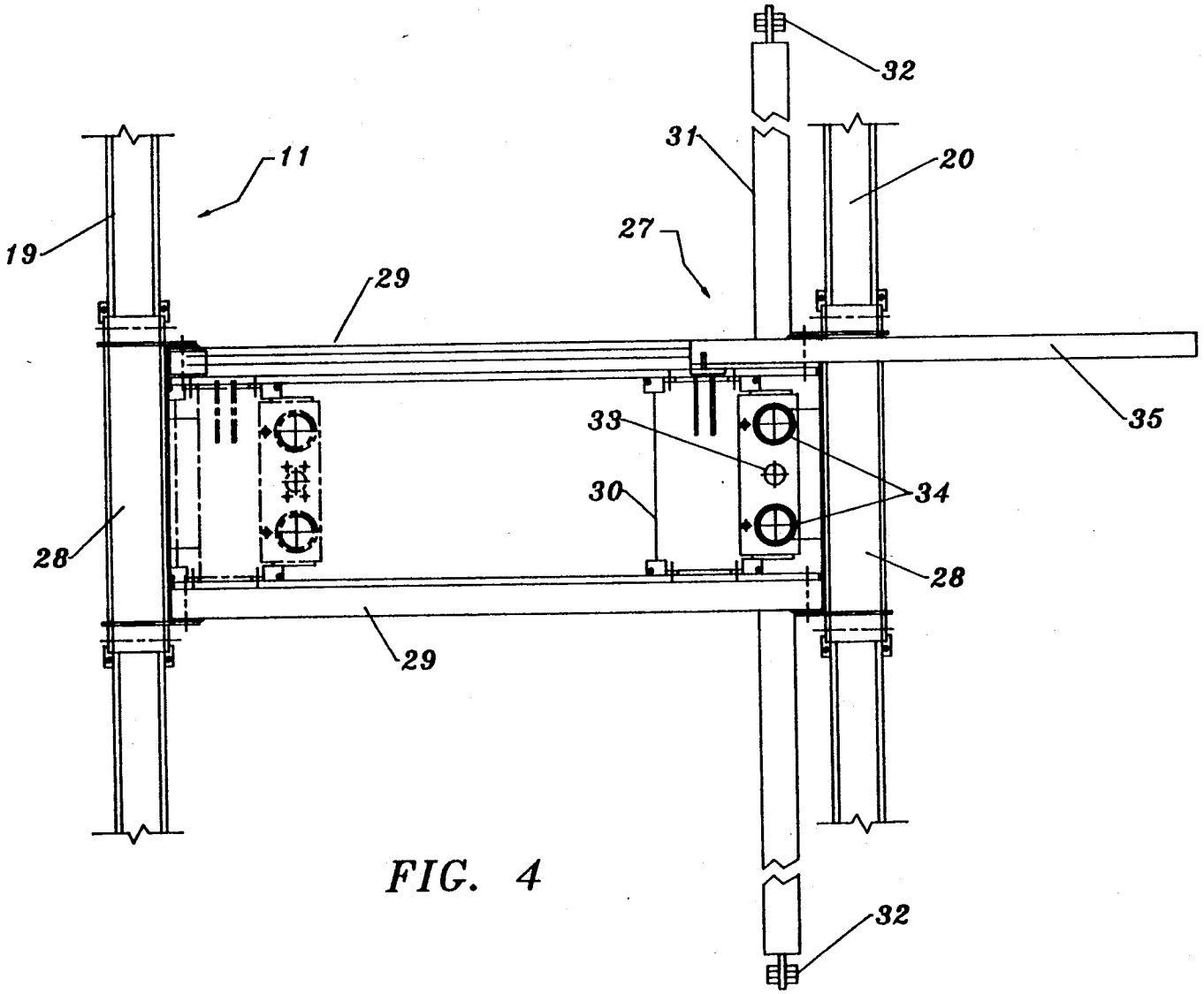
FIG. 4 is a top plan of the view of FIG. 3.

In the accompanying drawings, FIGS. 1 and 2 show a slant service rig incorporating one form of a derrick assembly 10 according to the present invention, FIG. 3 is a cross-section of the assembly 10 taken on the line III—III of FIG. 1 and FIG. 4 is a plan view of the assembly 10 of FIG. 3. In the assembly 10, a derrick frame 11 is pivotally attached to a transporter vehicle 12 positioned at a slant well head 13 having a working floor 13A, the derrick frame 11 being aligned relative to the horizontal with the same slant angle as the well head. The illustrated frame 11 has an 84 foot clear working height so that it can accommodate double lengths of pipe sections and is preferably telescoped for easier transportation. With a 140,000 lb. load capacity, the derrick frame 11 can accommodate up to 7500 ft of stored tubing.

The derrick frame 11 is pivoted to the desired position by hydraulic cylinders 14 and is held in place by adjustable supports (stiff legs) 15 which can be locked into various fixed positions by hydraulic latch pins 16 which engage holes 17.

The derrick frame 11 is an open assembly of girders forming a base 18 (see FIG. 3) and lateral sidewalls 19 and 20, the outer side 21 of the derrick frame being open. The base and sidewalls together define an elongated channel having an open side opposite the base. The derrick frame incorporates a rack R in the channel formed by twelve upright dividers 22 extending from the base 18 towards the outer side 21 and running along the length of the storage section of the channel in the derrick frame and forming between them open-ended storage slots 23 for drilling pipe sections 24. If preferred, the dividers 22 need not be continuous and may instead be formed by aligned upright posts spaced at suitable intervals along the channel in the derrick frame 11. A rack floor RF is provided (see FIG. 2) to support the ends of the pipe section. The dividers 19 extend laterally from sidewall 20 only partially across the body of the derrick frame 11 leaving a clear channel part 25 between the final divider 22A and the sidewall 19 of the derrick frame 11. As can be seen most clearly from FIG. 2, in use the clear channel part 25 is aligned with the well head 13 so that a drill pipe section may be positioned in the clear channel while being added to or removed from the drill string at the well head. In fact, as mentioned earlier, the length of the derrick frame 11 is such that double sections of drill pipe 24 (i.e. two sections of normal length already attached together) may be stored in storage slots 23 or manipulated in clear channel part 25 by split blocks 26 (FIG. 3).

As shown in FIGS. 3 and 4, a pipe racking assembly 27 is fixed across the open outer side 21 of the derrick frame 11, approximately midway along the length of the derrick frame, for the purpose of removing double pipe sections 24 from the storage slots 23 to the clear channel 25, and vice versa. The racking assembly 27 is slidably mounted on the outer ends of sidewalls 19 and 20 of the derrick frame 11 via roller units 28 and includes an open framework gantry 29 supporting a pipe gripping unit comprising a laterally movable carriage 30 and an elongated pipe boom 31, positioned beneath the carriage 30, extending longitudinally of the derrick frame 11 and carrying pipe gripping elements 32. Movements of the pipe boom 31 towards and away from the base 18 are controlled by a hydraulic cylinder 33 and guided by a pair of chrome guide posts 34 extending through collars 34A fixed to the movable carriage 30. The lateral position of the carriage 30, and consequently also the pipe boom 31, is controlled by a second hydraulic cylinder 35 and is guided on rails provided on the gantry, as will be explained more fully later. This allows the pipe boom 31 to be lowered to the bottom of any one of the storage slots 23, as shown in dotted lines at the right hand side of FIG. 3, to collect a pipe section 24 from the rack R, to raise it above the rack as shown in solid lines, to move it laterally to a position above the clear channel 25 as shown in dotted lines at the left hand side of FIG. 3 and then to lower the pipe section to a position 36 aligned with the longitudinal axis of the drill string for attachment to the drill string. The racking assembly can of course be operated in reverse to remove a pipe section from the drill string and to place the pipe section in any one of the slots 23 of the rack R.

Figure 5:
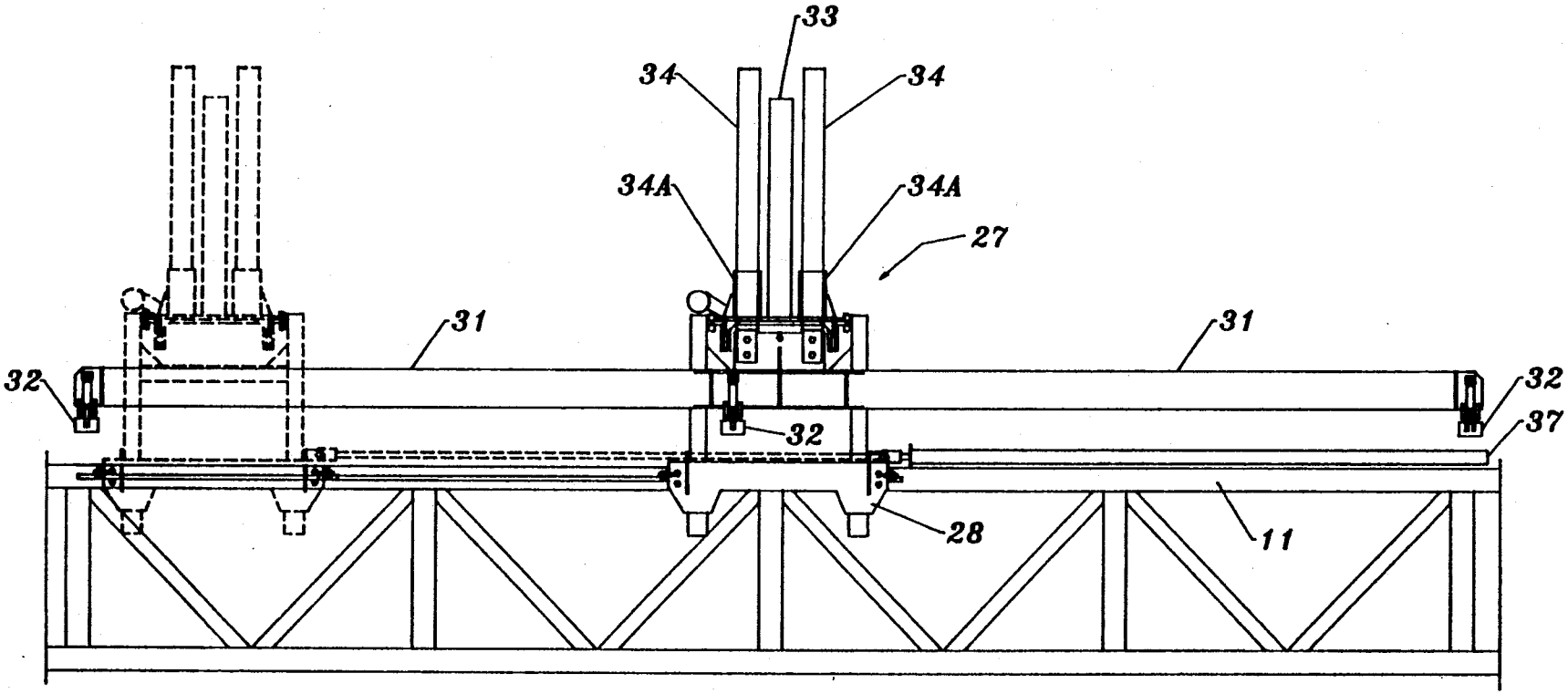
FIG. 5 is a side elevation of the derrick assembly in the region of the cross-section of FIG. 3.

The racking assembly 27 is shown in side view in FIG. 5. Roller units 28 slidably support the pipe racking assembly 27 on each side of the derrick frame 11. The longitudinal position of the racking assembly on the derrick frame is controlled by a pair of hydraulic cylinders 37 attached to the sidewalls of the derrick frame. The entire racking assembly 27 can thus be moved along the derrick frame 11 by several feet (normally 12.5 feet) to the position indicated by dotted lines at the left hand side of FIG. 5 (e.g. the bottom of the derrick). This allows pipe sections (not shown in FIG. 5) to be moved longitudinally in the direction of the axis of the drill string so that attachment to and removal from the drill string may take place.

Figure 7:
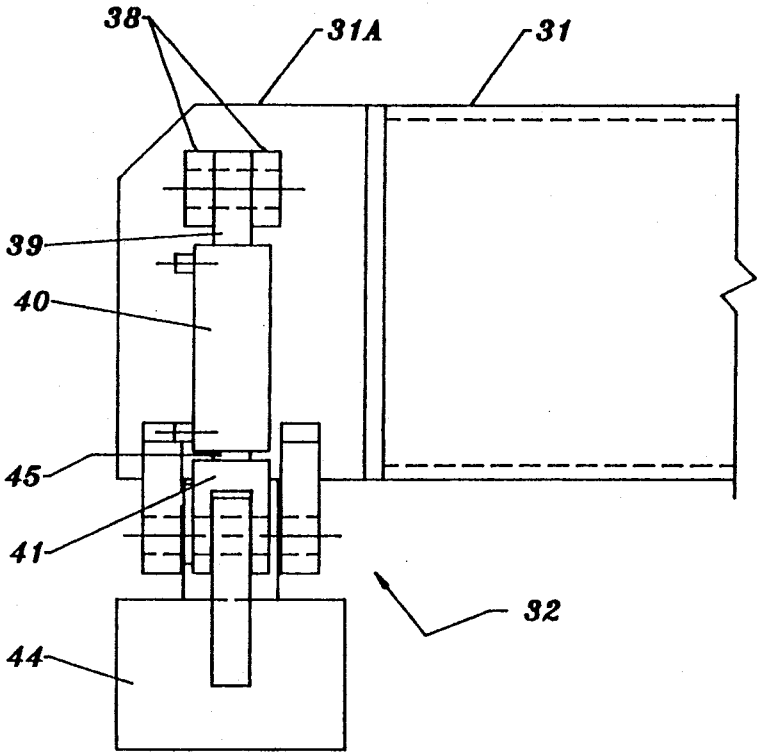
FIGS. 6 and 7 are an end view and side view, respectively, of gripper elements.
Figure 6:
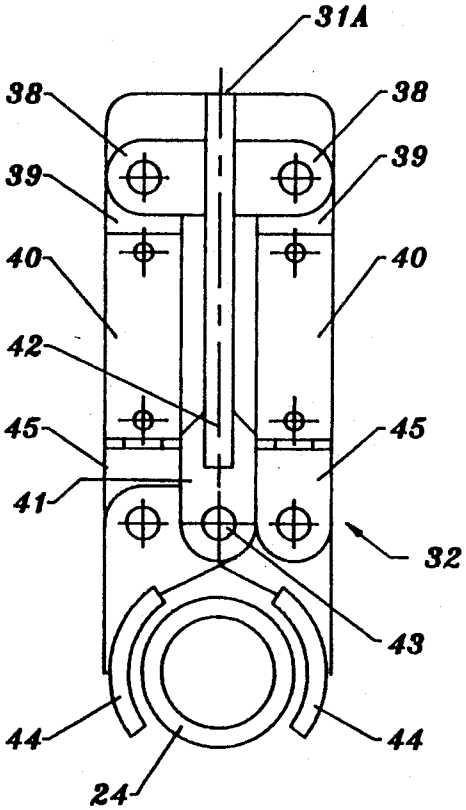

The pipe boom 31 carries three gripping elements 32, two at each longitudinal end and one approximately centrally. These gripping elements are shown in more detail in FIGS. 6 and 7 which show a gripping element 32 at one extreme end of the boom 31, but the other gripping elements are essentially the same.

Pipe boom 31 has a circular cross-section along most of its length but has "I" shaped sections 31A at the positions of gripping elements 32. The I-shaped sections have pairs of lugs 38 extending from each face near the top for receiving and pivotally retaining lugs 39 of operating cylinders 40. A pivot unit 41 extends from the lower edge 42 of the I-shaped section 31A and receives a pivot 43 for gripping jaws 44. The gripping jaws are pivotally attached to operating rods 45 extending from the lower ends of operating cylinders 40.

Operation of hydraulic cylinders 40 causes gripping jaws 44 to rotate around pivot 43 towards or away from each other to grip or release a pipe section 24.

Gripping elements 32 have a designed slip assembly to accommodate 20⅜, 20⅞, 30½ and 40½ inch tubing. This slip prevents the tubing from slipping through the grippers.

It will be understood from the above description that the racking assembly 27 has the ability to move pipe sections 24 towards or away from the base 18 in the planes of the slots 23, sideways above the rack R to or from the clear channel part 25 and longitudinally of the derrick frame 11 while being securely supported at three widely spaced positions by gripping elements 32 attached to pipe boom 31 which can grip or release the pipe sections as desired. The racking assembly therefore provides a convenient and safe way of transferring pipe sections between a drill string and a pipe section storage station.

Figure 8:
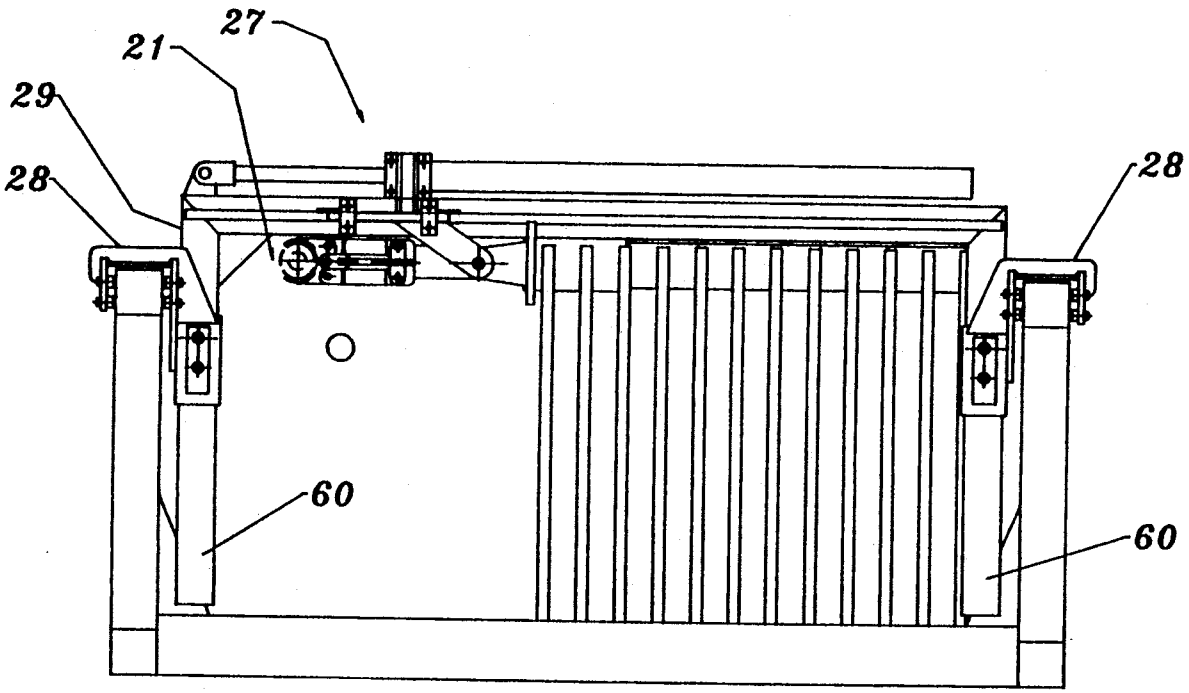
FIG. 8 is a view similar to FIG. 3 showing the unit in the stowed condition.

FIG. 8 is a cross section similar to FIG. 3 showing the racking assembly 27 in the stowed condition for transportation. It will be seen that the gantry 29 has been lowered into the derrick frame 11 and the pipe boom 31, operating cylinder 33 and guide posts 34 have been rotated to a horizontal position to lie across the open outer side 21 of the derrick frame 11. This arrangement has the advantages that the projecting cylinder 33 and posts 34 are folded away and the gantry 29 is lowered into the frame 11 so that the rig 12 will have minimum overall height. Naturally, during transportation, the derrick frame 11 is lowered to the horizontal position on the vehicle 12 from the slant position shown in FIG. 1.

The conversion of the racking assembly to the stowed condition shown in FIG. 8 is permitted by the design of the roller units 28 and the design of the movable carriage 30. The design details of these elements are described in more detail below.

Figure 11:
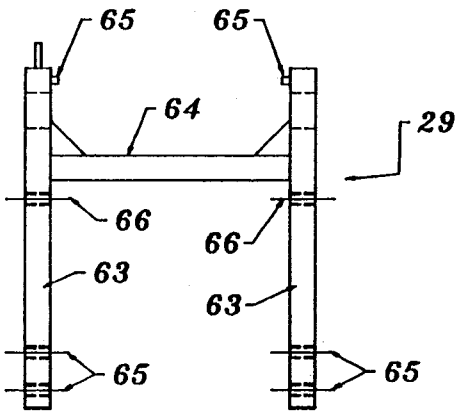
FIGS. 9 to 11 are enlarged views of a gantry in isolation.
Figure 9:
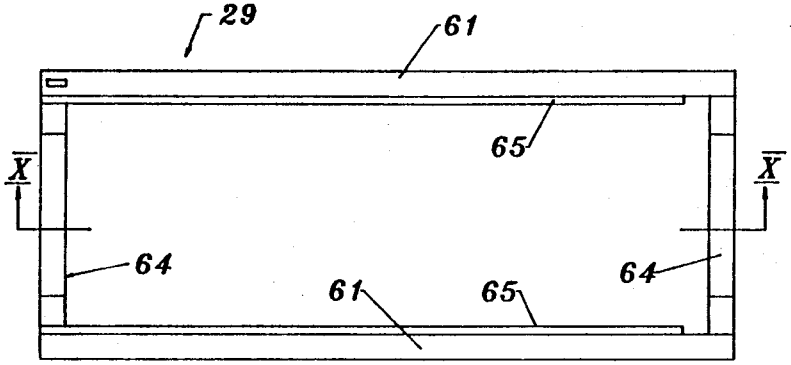
Figure 10:
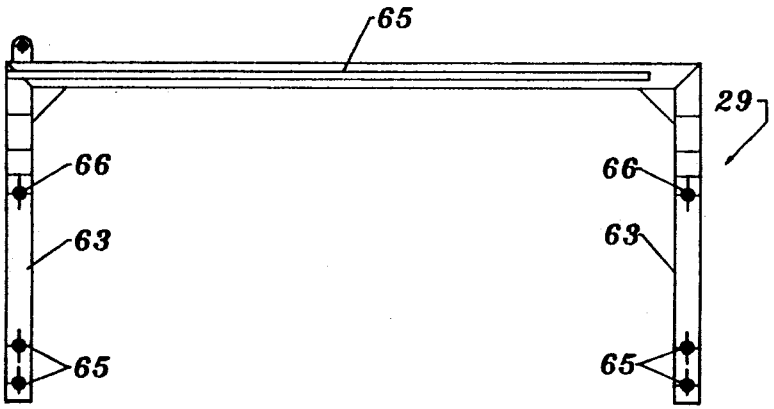

FIGS. 9, 10 and 11 are, respectively, a top view, a cross section along the line X—X of FIG. 9 and a side elevational view of the gantry 29 in isolation. The gantry consists of two transverse elements 61, four legs 63 and two longitudinal elements 64 connected together in the manner shown. The transverse elements 61 each have a small elongated rectangular rail 65 extending from an inner sidewall towards each other and these rails movably support the carriage 30 (see FIG. 13). The legs 63 each have a pair of holes 65 extending in the longitudinal direction of the derrick frame 11 at the bottom ends of the legs and a single hole 66 just below the attachment to the longitudinal elements 64. These holes are used to fix the gantry 29 in the roller units 28 either in the operating condition (holes 65) or in the stowed condition (holes 66).

Figure 14:
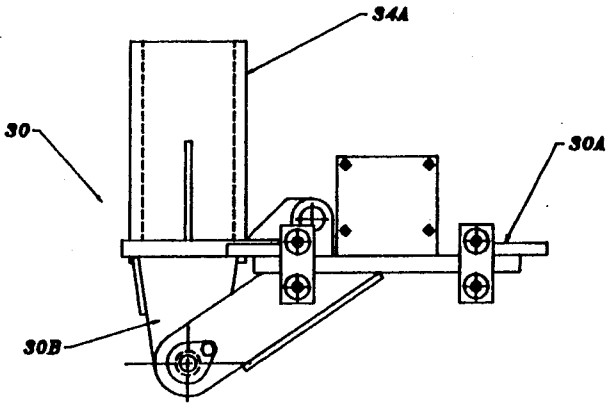
FIGS. 12 to 14 are views in isolation of a carriage unit slidable on the gantry.
Figure 12:
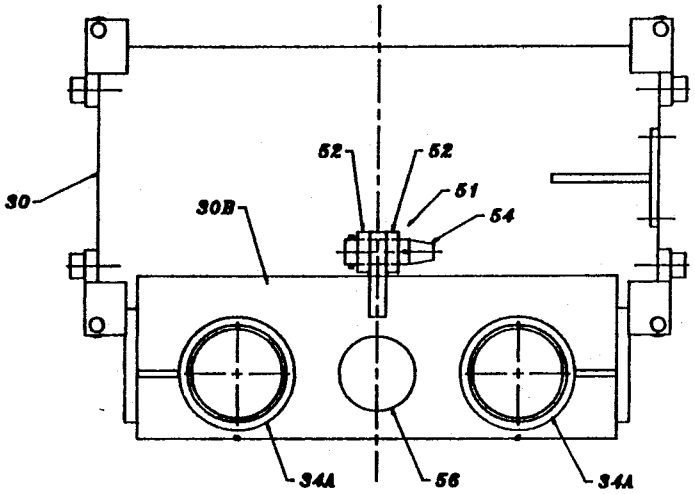
Figure 13:
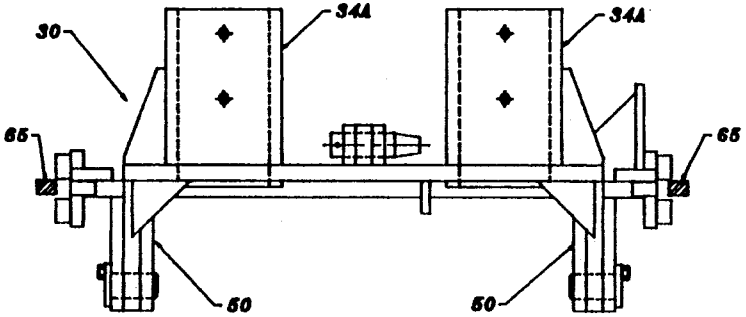

FIGS. 12, 13 and 14 are, respectively, a plan view, an end elevation and a side elevation of the carriage 30 which is movable carried on the rails 65 of the gantry 29. The carriage is in two parts 30A and 30B which are hingedly connected together by downwardly projecting lateral hinges 50. The two parts of the carriage 30A and 30B are held in the position shown in the drawings by locking element 51 which includes a pair of lugs 52 attached to the first part of the carriage 30A and a second lug 53 attached to the second part of the carriage 30B, the lugs having aligned holes receiving a removable locking bolt 54. Only after the bolt 54 has been removed can the two parts of the carriage move relative to each other around the hinges 50 from the operating position to the stowed position.

The part 30B of the carriage includes collars 34A for receiving the guide posts 34 and a hole 56 for receiving an operating rod of cylinder 33 (the cylinder is mounted on carriage part 30B). Thus, when the part 30B pivots about the hinges 50, the operating cylinder 33 (not shown) and guide posts 34 (not shown) also pivot to the stowed position as shown in FIG. 8.

When the gantry 29 is in the operating position, legs 60 are held in the roller units 28 by bolts extending through the pair of holes 65 and corresponding holes in the roller units 28. The bolt 54 is also in position through holes in the lugs 52,53 of the carriage 30 to lock the cylinder 33 and guide posts 34 in the upright position.

When the equipment is to be stowed, first of all the pipe boom 31 is moved over the clear channel part 25 (see FIG. 3) and is lowered until it rests against a block track below blocks 26 welded to base 18 of the derrick frame 11. The cylinders are then pressurized until they take the weight of the gantry 29 and the bolts are removed from the pairs of holes 65 at the ends of the legs 63 of the gantry. The cylinder is then used to lower the gantry 29 to the stowed position and a bolt is placed in each of the holes 66 in the legs of the gantry to lock the gantry in place. The boom 31 is then raised to the upright position, the carriage 30 is moved as far to the left hand side as possible, bolt 54 is removed from the lugs 52, 53 and the cylinder 33 and guide posts 34 are pivoted hydraulically to the stowed position. The reverse procedure sets up the equipment for operation.

It will be appreciated that the derrick assembly may be used to service a vertical well, in addition to a slant well as shown, merely by raising derrick frame 11 to the vertical position. The rack R may be designed with a small degree of slant relative to the derrick frame 11 (e.g. three degrees of slant) to prevent the pipes from falling out of the rack R when the derrick frame 11 is vertical.

In the apparatus of the present invention, at least in the preferred forms, pipe sections (preferably double lengths) are conveniently stowed in the derrick frame itself and are manipulated entirely by power devices between the drill string and the storage station. The equipment is thus efficient and safe.

Figure 15:
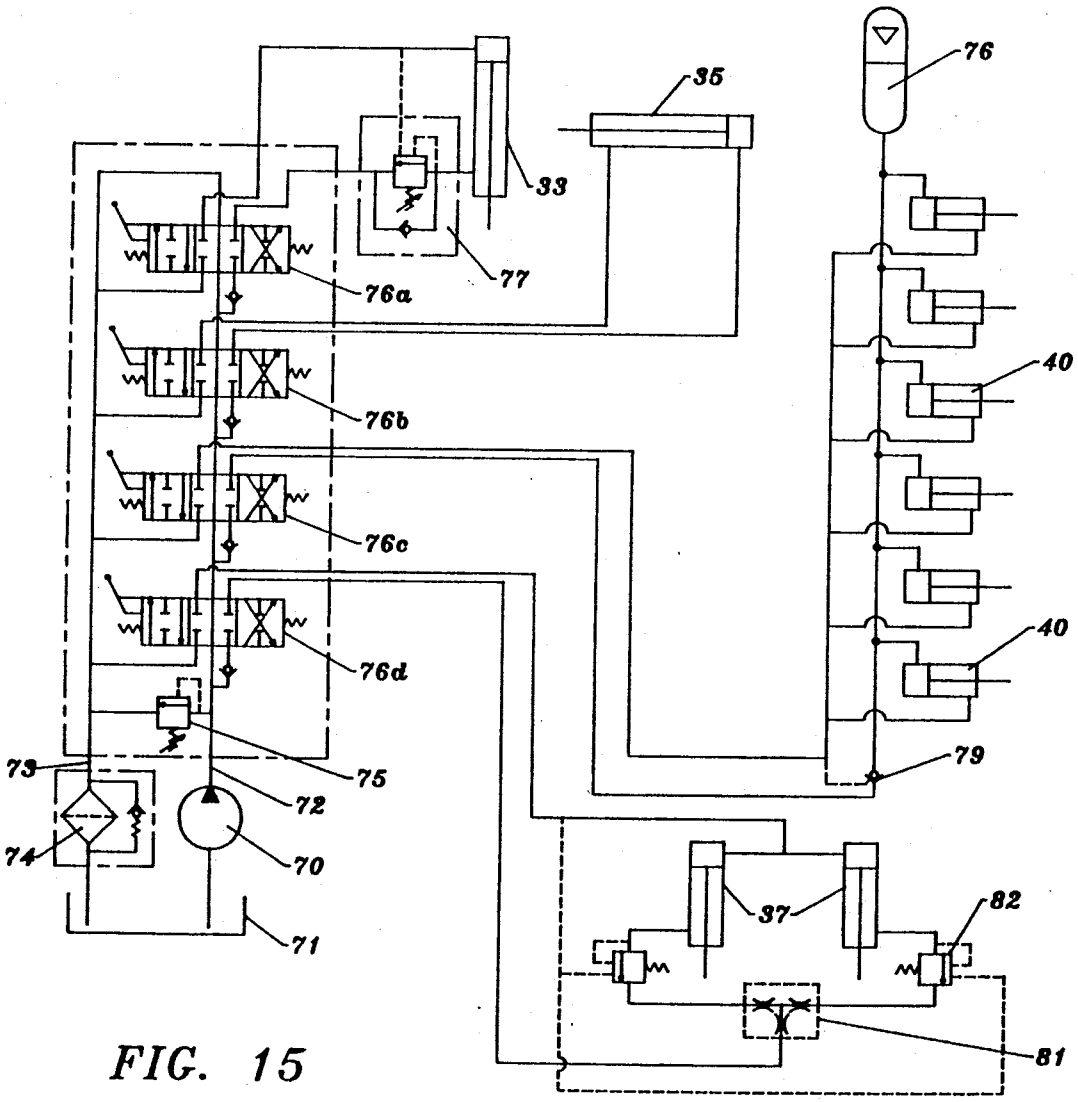
FIG. 15 is a schematic hydraulic circuit diagram.

A hydraulic control system for the derrick assembly of the invention is shown in FIG. 15. It includes a hydraulic pump 70 with an inlet from hydraulic fluid reservoir 71. The fluid outlet from the pump is supplied to the system via feed line 72 and the fluid returns to the reservoir via return line 73 through return flow filter 74.

The control unit includes a directional valve 75 and four solenoid valves **76*a*, 76*b*, 76*c* and 76*d*. The solenoid valve 76*a* is used to actuate arm cylinder 33 and the flow circuitry includes a counterbalance valve 77. The solenoid valve 76*b* actuates horizontal carriage cylinder 35. The gripper cylinders 40 are actuated by solenoid valve 76*c* and the flow circuitry for the gripper cylinders includes an accumulator 78 and a check valve 79. The solenoid valve 76*d* is used to actuate the virtual carriage cylinders 37. The fluid circuitry for these cylinders includes a flow divider/combiner valve 81 and a pair of counterbalance valves 82**.

While preferred forms of the invention have been described in detail, it will be apparent to persons skilled in the art that various changes and modifications could be made without departing from the scope of the invention as defined by the following claims.

What we claim is:

1. A derrick assembly for raising or lowering a drill string made of interconnected pipe sections, comprising:

a derrick frame having lateral sidewalls and a base together defining an elongated channel having an open outer side opposite to said base;

a rack positioned within said channel adjacent to one lateral sidewall thereof leaving part of said channel clear for manipulating said drill string, said rack comprising at least one element extending between said base and said open outer side for housing pipe sections therebetween substantially longitudinally aligned within said channel;

a gantry extending across said open outer side of said channel, said gantry being movable longitudinally of said channel; and a pipe gripping unit supported by said gantry for selectively holding or releasing pipe sections, said gripping unit being movable on said gantry towards or away from said base and laterally between said sidewalls;

whereby said pipe gripping unit may be manipulated on said gantry to transfer pipe sections between said rack and said clear part of said channel for attachment to or detachment from said drill string.

2. A derrick assembly according to claim 1 wherein said derrick frame is of such a length that two mutually interconnected pipe sections may be received within said channel and transferred between said rack and said clear part of said channel.

3. A derrick assembly according to claim 1 wherein said pipe gripping unit comprises an elongated boom supporting a plurality of power-operated gripping elements at longitudinally spaced positions.

4. A derrick assembly according to claim 3 wherein said boom is of such a length that it can securely grip two mutually interconnected pipe sections.

5. A derrick assembly according to claim 1 wherein said rack comprises a plurality of elements extending between said base and said open outer side defining elongated slots therebetween for receiving said pipe sections.

6. A derrick assembly according to claim 3 wherein said pipe gripping unit includes a carriage laterally movable on said gantry, said boom being movably supported on said carriage.

7. A derrick assembly according to claim 6 wherein said carriage includes two parts hingedly connected together, one of said parts being movably supported on said gantry and another of said parts supporting said boom, said parts being relatively movable between an operating position and a stowed position.

8. A derrick assembly according to claim 6 wherein said gantry is movably supported on said derrick frame and is movable between an operating position and a stowed position, said stowed position being closer to said base than said operating position.

9. A derrick assembly according to claim 6 wherein guide posts extend from said boom at spaced positions and pass through cylindrical collars on said carriage in order to stabilize said boom while permitting movement of said boom towards and away from said base.

10. A derrick assembly according to claim 1 wherein movements of said pipe gripping unit are controlled by hydraulically actuated cylinders.

11. A racking assembly for attachment to a derrick frame having lateral sidewalls and a base together defining an elongated channel containing a rack for holding pipe sections adjacent to a clear part of said channel for manipulating a drill string, said racking assembly comprising:

a gantry movably supportable on said sidewalls; and a pipe gripping unit supported by said gantry for selectively holding or releasing said pipe sections, said gripping unit including an elongated pipe boom parallel to pipe sections in the rack, said boom having at least two longitudinally spaced gripping elements mounted thereon with gripping jaws for gripping a pipe sections, said gripping unit being adapted to hold the pipe sections in vertical or slant positions and being movable on said gantry when in use towards and away from said base and laterally between said sidewalls.

12. A racking assembly according to claim 11 wherein the elongated pipe boom has three longitudinally spaced gripping elements.

* * * * *